United States Patent [19]

Kistner

[11] Patent Number: 4,919,597

[45] Date of Patent: Apr. 24, 1990

[54] PUMP APPARATUS FOR MULTIPLE COMPONENT FLUIDS

[75] Inventor: Kenneth J. Kistner, Midlothian, Tex.

[73] Assignee: Specified Equipment Systems Co., Inc., Dallas, Tex.

[21] Appl. No.: 206,658

[22] Filed: Jun. 15, 1988

[51] Int. Cl.[5] ..... F04B 9/08; F04B 23/04

[52] U.S. Cl. ..... 417/403; 417/554

[58] Field of Search ..... 417/397, 403, 404, 393, 417/401, 554, 540; 91/275, 323, 324, 463

[56] References Cited

U.S. PATENT DOCUMENTS

| | | | |
|---|---|---|---|
| 2,755,966 | 7/1956 | Lindars | 91/323 X |
| 3,330,211 | 7/1967 | Faro et al. | 417/403 X |
| 3,827,339 | 8/1974 | Rosen et al. | 417/554 X |
| 3,906,845 | 9/1975 | Wegmann | 417/554 X |
| 4,630,523 | 12/1986 | Tersteegen | 91/463 X |

FOREIGN PATENT DOCUMENTS

| | | | |
|---|---|---|---|
| 2037880 | 7/1980 | United Kingdom | 417/403 |

*Primary Examiner*—Leonard E. Smith

*Attorney, Agent, or Firm*—Richards, Medlock & Andrews

[57] ABSTRACT

A pump assembly or for pumping one or more fluids includes a drive piston pump which reciprocates to drive proportion pumps. Fluid to the drive piston pump is controlled through a pair of two-position, three-port valves which communicate pressurized fluid sequentially above and below the drive pump piston to reciprocate the piston. While applying fluid pressure to one face of the piston, the opposite face is vented to tank such that no back pressure exists in the system. A proportion pump is provided for each fluid pumped by the system and is designed to pump upon movement in either direction. A check valve is fitted on the outlet of the proportion pump to maintain constant pressure in the hose attached to the proportion pump and to prevent back flow of fluid from the hose into the system. The hose is of sufficient length so as to modulate any variations in the pumping pressure.

6 Claims, 3 Drawing Sheets

48
40
42
30
20
26
60
64
50
56
38
24
80
A
B
C
36
22
32
72
62
66
54
52
340
82
34
94
290
92
90
84
70
358
204
96
332
316
326
310
300
206
314
208
312
322
324
320
356
200
319
202
327
330
210
321
212
328
214
216
236

270
272
282
234
260
256
258
262
294
252
254
240
242
248
244
250
246
230
232

PUMP APPARATUS FOR MULTIPLE COMPONENT FLUIDS

TECHNICAL FIELD

The present invention relates to a pumping system and more particularly to a system used for pumping single or multi-component materials, including coatings or polyurethane foams.

BACKGROUND ART

Pumping systems of many designs have been used to transfer material for application by spraying or other means. However, in the application of many coatings and other single and multi-component materials, special problems have been encountered. These problems include the need to precisely pump specified quantities of material and provide such materials at a near constant and continuous pressure at a remote location from the pump equipment. Further, the pump equipment must be capable of pumping large volumes of material at high pressures. In many cases, the materials being pumped are very caustic requiring the need for equipment which can fulfill these requirements even though it is subjected to continuous exposure to such materials.

In the past, various systems have been used. One widely used pump system for the application of multi-component polyurethane foams incorporates an air motor which drives dual proportion pumps, with each proportion pump designed to pump one of the components to be sprayed. The components are then mixed at a discharge gun prior to application. The air motor incorporates a piston moving in a cylinder with air being sequentially applied above and below the piston to reciprocate the piston. A reversing switch is actuated as the piston reaches a predetermined position in its travel and air pressure is alternated to the opposite side of the piston. Air on the driven side is then exhausted to the atmosphere. When the system is in the "off" position, air is normally maintained under pressure on one face of the air motor piston subjecting the seals to extremely large pressures during all times the unit is in use, even though in the "at rest" or "off" position.

The air motor drives one or more proportion pumps which pumps the fluid to the applicator gun. The proportion pumps each include a piston driven in a cylinder. The proportion pump is referred to as a double acting pump in that during one stroke the fluid loaded below the piston is in part pumped to the applicator gun. However, a portion of this material, and in most cases one-half of the volume, is pumped above the piston and around the piston rod, such material being discharged on the reciprocated stroke. These proportion pumps are designed in the manner in an effort to achieve the pumping of an almost equal amount of material on the downstroke as on the upstroke.

While these systems have met with some success, they have also presented substantial problems. First, to maintain pressure in the lines between the proportion pumps and the discharge gun, the air motor is constantly subjected to pressure, placing the seals and other components under continuous stress. Further, the proportion pumps are not efficient in that on one stroke, fluid being pumped is pumped into the cylinder above the piston and around the piston rod. Up to one-half of the pump volume is used simply to recharge and reposition the piston within the cylinder. However, during this stroke, line pressure is communicated to the area above the piston and because the pressure in the line is greater than the pressure in the cylinder, fluid previously pumped is forced backed into the cylinder above the piston and around the piston rod, resulting in the loss of volume and pressure in the entire system. Because this design permits previously pumped fluid to back-flow into the cylinder, requiring it to be repumped a second time, the system is highly inefficient.

Further, when the gun of the unit is shut off, with the air motor under continuous pressure, the piston in the proportion pump continues to creep in the cylinder causing fluid to move around the piston seals and applying loads to all of the components. This action causes substantial wear and premature failure of the seals. Likewise, the air motor is under continuous pressure during the operation of the system, even when spraying is not being accomplished.

Therefore, the presently used system does not provide an efficient design which will produce a high output at extended distances from the pump equipment while maintaining only a minimum pressure on the system components.

DISCLOSURE OF THE INVENTION

The present system provides a pump assembly for pumping one or more fluids. These fluids may include all types of materials and coatings which are sprayed or applied by other applicators and may also include the dual component fluids which are mixed to chemically react, such as polyurethane foam materials. In one embodiment of the invention, the pump systems includes a drive piston for movement in an appropriate cylinder. Valves are used to control the reciprocation of the drive piston by controlling the application of fluid on opposite sides of the piston. The drive piston reciprocates to drive proportion pumps which are reciprocated by the reciprocating movement of the drive piston. A proportion pump is used for each fluid which is being pumped by the system.

Fluid to the drive piston is controlled through a pair of two-position, three-port valves. These valves are switched by solenoids which are controlled by a reversing switch triggered by the engagement of a reversing collar attached to the shaft of the power cylinder. Reciprocation of the power cylinder is accomplished by communicating pressurized fluid above the power cylinder through one of the control valves while venting the cylinder on the opposite side of the power piston to tank. Venting of the fluid to tank is through a solenoid control valve, which produces no back pressure as a result of its design. When the power cylinder has reached the end of its downward stroke, a reversing switch is actuated causing a reversal of the flow of material such that the pressurized fluid is communicated below the power piston and the cylinder above the power piston is vented to tank. Again, the valve is designed such that the vent to tank produces no back pressure such that the power piston is free to move under the action of the pressurized fluid below it. This reciprocation of the power piston is then communicated by way of a yoke or other connection to the proportion pumps.

A proportion pump is provided for each fluid pumped by the system. The proportion pump has a cylinder with a piston attached to a piston rod which reciprocates therein. The discharge end of the cylinder is occupied by the piston rod. An inlet is positioned in the end opposite that occupied by the piston rod and a first check valve is positioned in the inlet for permitting the fluid to flow into the cylinder but preventing flow past the check valve out of the cylinder. A valve port is also positioned within the piston for communicating flow of fluid therethrough. A second check valve is fitted in this valve port associated with the piston valve and permits the flow of fluid from below to above the piston but prevents the flow of fluid from above to below the piston. A third check valve is fitted at the outlet of the discharge exhaust to maintain constant pressure in the hose when closed and allow the flow of fluid outwardly only when opened. Seals are fitted on the piston to form a fluid seal between the piston and cylinder walls during both stroke directions thereby opening the third check valve at the exhaust outlet upon movement of the piston. At the end of each stroke, the third check valve momentarily closes to prevent fluid from backing into the fluid cylinder which allows the trip cycle to be completed. However, any time pressure in the cylinder is less than pressure in the hose, the third check valve closes preventing the flow of fluid from the hose into the cylinder. The seals on the piston form a fluid-tight seal whether the piston is moving or at rest.

The proportion pumps pump positive volume and positive pressure on the full motion of each stroke. As the piston moves up, the second check valve associated with the piston valve port is in its closed position thereby pumping fluid pressure which is above the piston out of a discharge exhaust at the third check valve opening to the hose. As the piston moves downwardly in its cylinder, the first check valve in the inlet is closed causing fluid to pass from below to above the piston through the piston valve means. Because the upper portion of the cylinder is partially filled by area of the piston rod, the volume of material below the piston is forced through the piston to the upper portion of the cylinder during the downstroke and in conjunction with the directional seal placement, this structure immediately creates and maintains positive pressure and positive flow of fluid during the entire downstroke at all delivery pressures.

A hose is connected to the discharge exhaust from each proportion pump and receives the pumped fluid therefrom. The hose is of sufficient length so as to modulate any variations in the pumping pressure resulting from the reciprocating pumping. It has been found that most any inside diameter hose or length may be used. However, the longer the hose and the greater its inside diameter, the more efficient the system and the more even modulation achieved. In one embodiment, a one-half inch (1.27 cm) inside diameter hose having approximately 200 feet (60.96 m) or more in length is used to modulate pressure derived from the present system. Thus, by using the present invention, the pumping pressure at the end of the hose is maintained substantially uniform without any modulation. Further, because the proportioned pumps pump positive pressure and volume without loss on either the down or up strokes, larger volumes of material may be pumped at longer distances while maintaining constant pressure.

An applicator gun is attached to the end of the hose remote from the proportion pumps. One or more fluids being pumped by the system are delivered to the gun for mixing and spraying or other application. As previously described, exhaust, or third check valves are positioned immediately downstream of the exhaust outlets from the proportion pumps. At any time the system is not actuated, that is, fluids are not being pumped, pressure is maintained in the hoses between these check valves and the applicator gun. Thus, the hoses are pressurized and serve as a pressure vessel making the system ready for operation upon reactivation of the drive piston. However, when fluid is not being pumped from the applicator gun, the solenoid valves which control the operation of the power piston are turned off and fluid both above and below the power piston are vented to tank. Thus, there is no pressure on either the power piston or on the proportion pumps when the system is not in the pumping mode. When the operator is ready to commence spraying, the appropriate solenoid controlling the power piston is actuated by virtue of the position of the reversing switch and admits pressurized fluid either below or above the power piston to apply pressure to the fluid lines by way of the proportion pumps. As soon as the pumps have moved sufficiently to meet or exceed the pressure in the lines downstream of the exhaust check valves, the system is ready for use by the operator by simply triggering the applicator gun.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
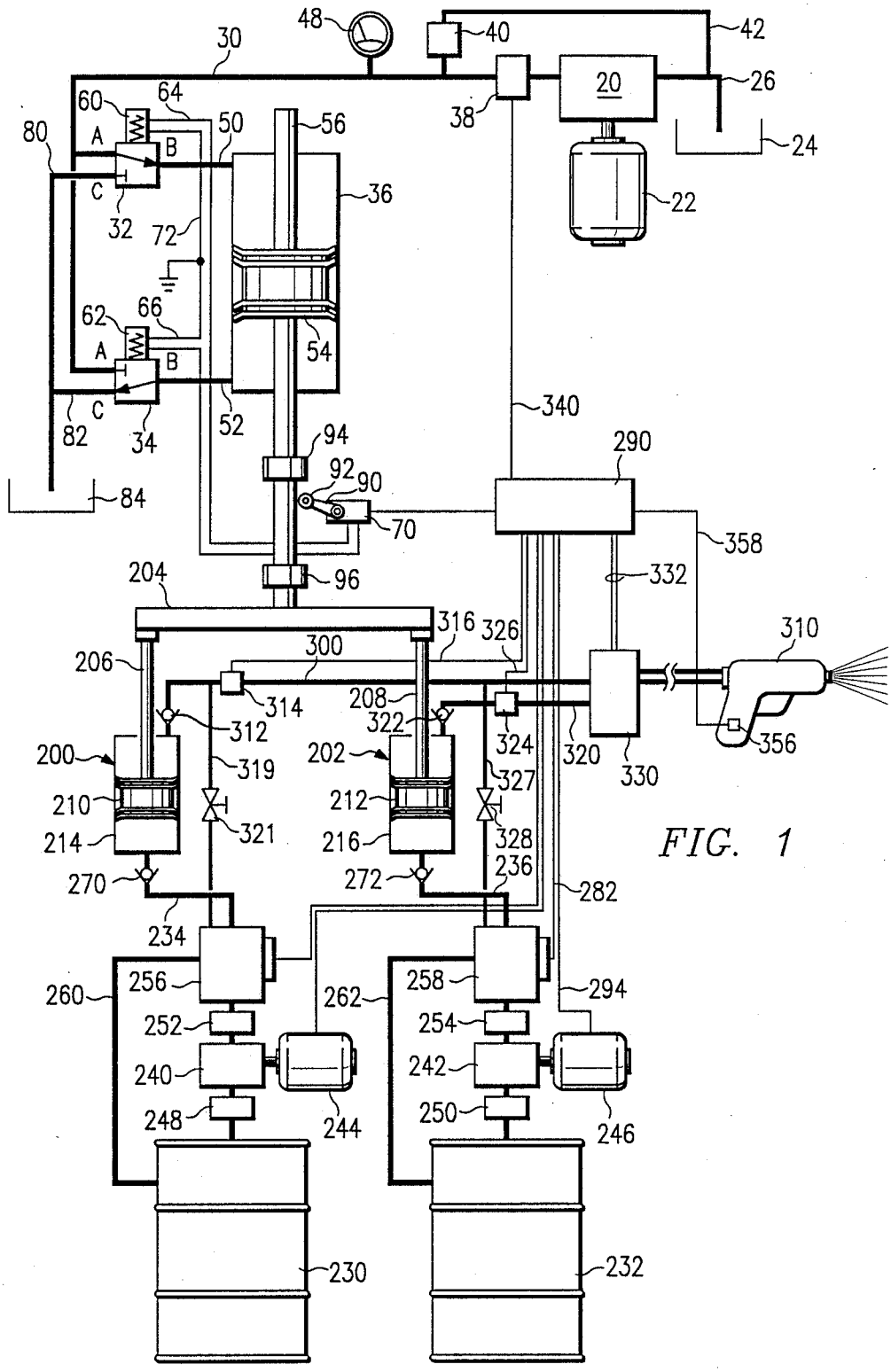
FIG. 1 is partially schematic illustration of the pumping system of the present invention.

Referring now to FIG. 1 which is a schematic of the overall pump system of the present invention, the system includes a supply pump 20 driven by an electric motor 22. Supply pump 20 is fed from tank 24 and is connected thereto by an appropriate flow line 26. Supply pump 20 is connected by supply line 30 to a pair of two-position, three-port valves 32 and 34. Valves 32 and 34 are, in the preferred embodiment, identical and control the flow of fluid from supply pump 20 to a power cylinder 36. An electric control valve 38 is mounted within supply line 30. Likewise, an adjustable relief valve 40 is positioned along supply line 30 and operates to channel fluid by way of line 42 to tank 24 whenever pressure in line 30 exceeds a pre-determined level. A pressure gauge 48 is also mounted in supply line 30.

A power or drive piston 54 moves with a shaft 56 within cylinder 36. Shaft 56 is journaled through appropriate ports in the upper and lower end of cylinder 36. A fluid line 50 is connected from valve 32 to cylinder 36 above piston 54 while fluid line 52 is connected from valve 34 to cylinder 36 below piston 54.

Valves 32 and 34 are each controlled by appropriate solenoids 60 and 62, respectively. Solenoids 60 and 62 are connected by power leads 64 and 66 to a reversing switch 70, and are grounded by ground lead 72. Valves 32 and 34 are also connected by lines 80 and 82 to a tank 84 as shown. It will be appreciated that tank 84 may be the same tank as tank 24 from which fluid is supplied to supply pump 20.

Reversing switch 70 has a trip switch lever 90 with a roller 92 attached on the end thereof. A pair of reversing collars 94 and 96 are mounted for movement on an extension below cylinder 36 of power cylinder shaft 56. As piston 54 reciprocates within cylinder 36, as hereinafter will be described, collars 94 and 96 alternately engage roller 92 on switch lever 90 to reverse switch 70 which in turn operates solenoid 60 and 62 to control the flow of fluid into and out of power cylinder 36.

Figure 2A:
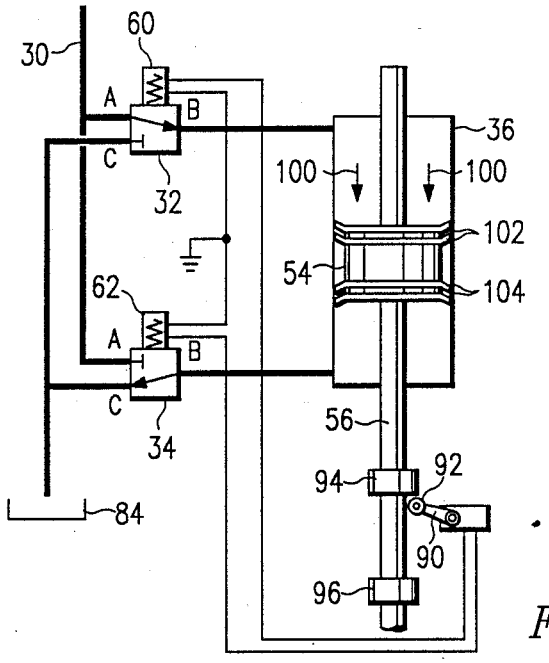
FIGS. 2*a* and 2*b* show a more detailed schematic of the power piston and control valves therefor.
Figure 2B:
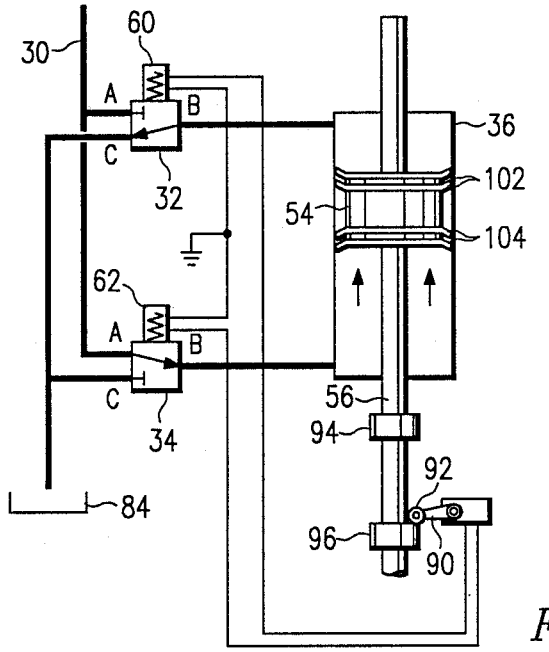

The detailed operation of power cylinder 36 and the control mechanism for operating this drive system is shown in more detail in FIGS. 2*a* and 2*b*. Referring to FIG. 2*a*, valve 32 has an inlet port A, an outlet port B to cylinder 36 and an outlet port C to tank 84. Similarly, valve 34 has an inlet port A, an outlet port B to cylinder 36 and an outlet port C to tank 84. Both valves 32 and 34 are two-positioned, three-port valves. The two positions for valves 32 and 34 are shown in FIGS. 2*a* and 2*b*. Specifically, as is shown in FIG. 2*a*, one position is a connection between ports A and B which permits the flow of fluid from supply line 30 through valve 32 and to cylinder 36. The second position, shown for valve 32 in FIG. 2*b*, is the connection between ports B and C permitting the flow of fluid from cylinder 36 to tank 84. Similarly, these two positions are also the positions for valve 34. Referring to FIG. 2*a*, with switch lever 90 in the up position, solenoid 60 of valve 32 is energized to its retracted position permitting the connection of ports A and B and the flow of fluid from supply pump 20 through supply line 30 into cylinder 36 above piston 54. Simultaneously, solenoid 62 of valve 34 is not energized placing the valve in the "open" position and connecting ports B and C. This allows fluid from below piston 54 to be vented to tank 84 at the same time that pressurized fluid is introduced above piston 54 into cylinder 36. As a result, piston 54 is driven downwardly as depicted by arrows 100 in FIG. 2*a*.

As can be appreciated, all of the energy provided by pressurized fluid entering cylinder 36 above piston 54 acts to drive the piston in the downward direction in that fluid below piston 54 is vented to tank 84. As will be shown hereafter in more detail, through the use of the two-position, three-port valves, the venting provided by the connection between ports B and C of valve 34 assures that there is no back pressure to resist the movement of piston 54. As the piston reaches the lower most travel within cylinder 36, reversing collar 94 engages switch lever 90 thereby reversing the positions of valves 32 and 34 to that shown in FIG. 2*b*. As a result, solenoid 60 is de-energized opening the upper portion of the cylinder to tank 84 while solenoid 62 is energized to make the connection between ports A and B allowing the flow of pressurized fluid into cylinder 36 below piston 54. This results in the upward movement of the piston as shown in FIG. 2*b*. As piston 54 reaches the upper most portion of its travel, reversing collar 96 on shaft 56 engages reversing switch lever 90 which again reverses the switch positions of valves 32 and 34 and the cycle is repeated. It can be seen from FIG. 2*a* that piston 54 has a plurality of upper and lower seals 102 and 104, respectively, which provide a fluid type seal between the piston and the cylinder. These ring seals are pressure controlled to form a complete seal upon pressurization on one side or the other of the piston.

Figure 3A:
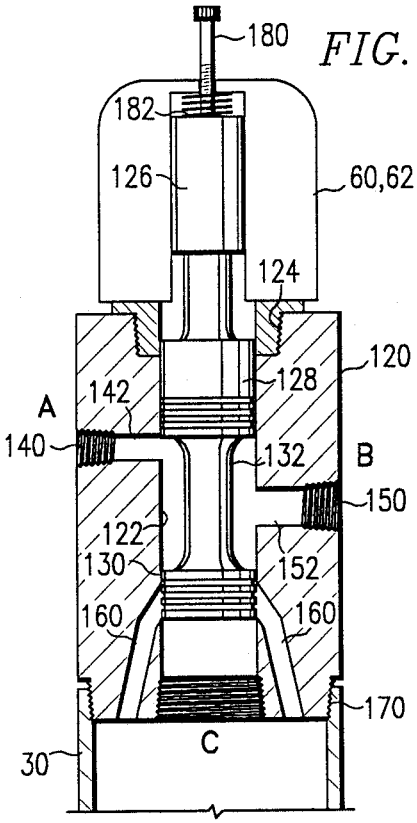
FIGS. 3*a* and 3*b* are enlarged section views of one of the control valves used to control the power piston.
Figure 3B:
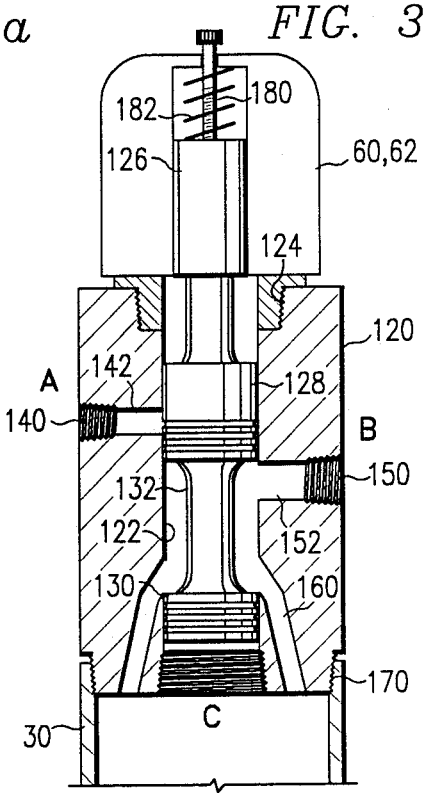

A significant feature of the present invention is the use of the two-position, three-port valves which make possible the elimination of back pressure on piston 54 during the introduction of pressurized fluid on the opposite face. FIGS. 3*a* and 3*b* illustrate valve 32 and 34 and the structure therein which accomplishes this result. Referring to FIG. 3*a*, it can be seen that valves 32 and 34 include a main body 120 having a bore 122 therethrough with an enlarged threaded bore 124 in the upper portion thereof. Solenoid 60, 62 is threadedly received within bore 124 and has a spool 126 slidable therein. Spool 126 has an intermediate valve piston 128 with an end piston 130 connected thereto by a reduced diameter rod section 132. The actuated position of solenoid spool 126 is as shown in FIG. 3*a*, that is, in the retracted position. Port A includes a threaded internal bore 140 connected by way of a smaller bore 142 with bore 122. Port B includes a internally threaded bore 150 connected by way of a smaller bore 152 to central bore 122. Port C is provided by a plurality of apertures 160 extending from central bore 122 and communicating to the lower end of main body 120. These apertures provide a flow channel which is greater in flow capacity than the flow channel provided from port A to B. The main body 120 has external threads 170 which receive an appropriate fitting for connection to supply line 30.

As can be seen in FIG. 3*a*, with solenoid spool 126 in the actuated or retracted position, piston 128 is above the opening of bore 142 into central bore 122 thereby permitting communication between port A and port B. Also, piston 130 is positioned within central bore 122 above apertures 160 thereby closing any communication between either port A and/or port B with port C. Thus, when the solenoid 60, 62 is actuated, port A and B are connected to permit flow from A to B while preventing flow from either A or B to port C.

FIG. 3*b* shows the position of valve 32, 34 when there is no power to the system, that is, when solenoids 60, 62 are in the unactuated position. As shown in FIG. 3*b*, spool 126 is spring loaded to the extended position. Spring 182 acts between the housing of solenoid 60 and spool 126 to position the spool as shown. In this position, piston 128 overlies the opening of bore 142 from port A into central bore 122, closing it. However, in this extended position, piston 130 is positioned below the openings of apertures 160 into central bore 122. Likewise, the opening of bore 152 communicating with port B is also opened, thereby connecting port B to port C.

It will be appreciated that in the valve disclosed in FIGS. 3*a* and 3*b*, a substantial number of apertures 160 are provided circumferentially arranged around central bore 122. Because the opening is a direct opening from port B to port C, and not, for example, an opening across a valve land, the volume of flow permitted in the design will prevent any back pressure. Rather, in the valve of the type shown in FIG. 3*a* and 3*b*, the flow capacity between ports B and C may be on the order of 30 gallons per minute whereas the flow capacity from ports A to B can be on the order of 10 gallons per minute. This flow capacity of 30 gallons per minute can be accomplished even in a nonpressurized, but rather exhaust mode. Therefore, because of the incorporation of the particular valves shown in FIGS. 3*a* and 3*b*, the movement of piston 54 is unencumbered by the existence of fluid on the side of the piston opposite the working pressure used to drive the piston.

This arrangement represents a significant divergence from prior art where the same result may be attempted by using a two-position, four-port valve. In these valves, the exhaust of fluid must travel across a restrictive valve land, in view of the design which also requires the exhaust connection to serve, alternately, as the pressure connection. In such an arrangement, sufficient discharge of fluid is not possible thereby resulting in the generation of back pressure on the system. Such back pressure greatly hampers the free movement of the piston under pressure and therefore robs the system of substantial power which could otherwise be used in the pump cycle. Again, in the present invention, in view of the valve design used, the discharge of fluid from port B to tank port C is accomplished in such a way that there is no back pressure, except that generated in the discharge line itself resisting the movement of piston 54 during its power stroke.

Referring again to FIG. 1, it can be seen that power cylinder 36 drives a pair of proportion pumps 200 and 202. Specifically, power cylinder shaft 56 is connected to a yoke 204 which in turn has a pair of piston rods 206 and 208 attached on opposite ends thereof. Piston rods 206 and 208 are attached to pistons 210 and 212, respectively, which move within proportion pump cylinders 214 and 216, respectively. Proportion pumps 200 and 202 are fed by material from supply drums 230 and 232, respectively. Supply drums 230 and 232 are connected to proportion pumps 200 and 202 by supply lines 234 and 236, respectively. Material is drawn by pumps 240 and 242, which are driven by electric motors 244 and 246, respectively, through traps 248 and 250, respectively. This material is pressure fed through filters 252 and 254 into accumulators 256 and 258, respectively. For proportion pump 200, a return line 260 is provided from accumulator 256 to supply drum 230. For proportion pump 202, a return line 262 is provided between accumulator 258 and supply drum 232. A check valve 270 is positioned within flow line 234 between accumulator 256 and the inlet into proportion pump 200. Similarly, a check valve 272 is positioned between accumulator 258 and proportion pump 202. Accumulators 256 and 258 are connected by appropriate power lead 280 and 282, respectively, to a junction box 290. Electric motors 244 and 246 are connected by electrical leads 292 and 294 to junction box 290.

The exhaust discharge from proportion pump 200 is connected by flow line 300 to a discharge gun 310. A check valve 312 is positioned in this line in close proximity to the discharge outlet. A high pressure shut-off switch 314 is also mounted in pressure sensing relation to the flow line 300 and is connected by electrical lead 316 to junction box 290. Similarly, discharge outlet from proportion pump 202 is connected by flow line 320 to discharge gun 310. A check valve 322 is mounted within this flow line in close proximity to the discharge outlet. A high pressure shut-off switch 324 is connected in pressure sensing relationship in line 320 and is connected by electrical lead 326 to junction box 290. A manual bleed down line 319 with valve 321 is connected between line 300 and accumulator 256. A manual bleed down line 327 with valve 328 is connected between line 320 and accumulator 258. These valves permit bleeding of the lines when necessary. Both flow lines 300 and 320 are connected via heater block 330 where the fluid may be heated as required prior to passage to the discharge gun. Heater block 330 is connected by appropriate electrical leads 332 to junction box 290. As is seen in FIG. 1, junction box 290 is connected by electrical lead 340 to electronic control valve 38.

Figure 4A:
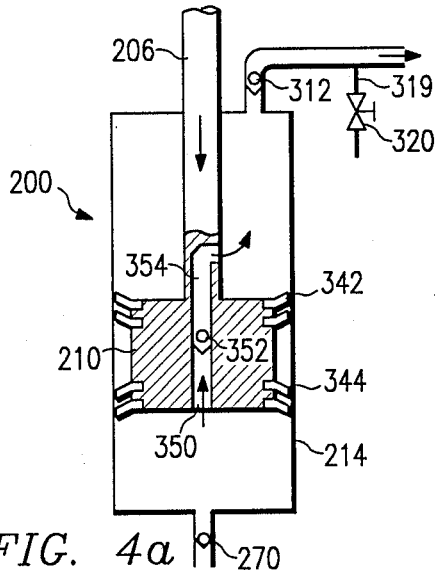
FIGS. 4*a* and 4*b* are vertical section views of one of the proportion pumps of the present invention.
Figure 4B:
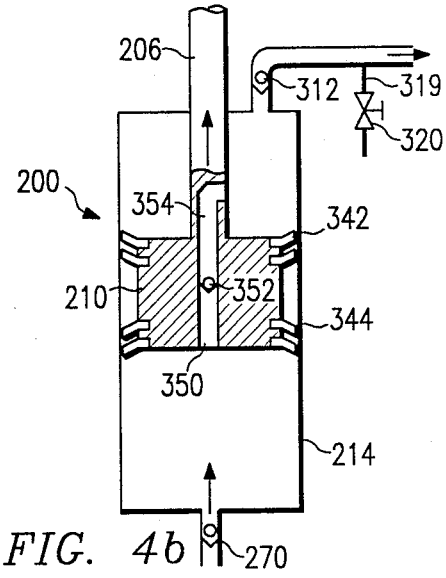

More detail of proportion pumps 200 and 202 is shown in FIGS. 4*a* and 4*b* by reference to a partially broken away section view of proportion pump 200. As can be seen in FIG. 4*a*, the pump includes a cylinder 214 having a piston 210 moving therein. A piston rod 206 is connected to piston 210 and has its end extending through the upper end wall of the cylinder. Piston 210 has appropriate upper and lower seals 342 and 344, respectively, to provide a fluid-type seal during both movement upwardly and downwardly as well as when the piston is at rest. Seals 342 form a fluid tight seal on the upstroke and seals 344 form a fluid tight seal on the downstroke. FIG. 4*a* shows the inlet check valve 270 and the outlet check valve 312. Further, a port 350 is provided through piston 210 and a check valve 352 is positioned therein. The check valve permits the flow of fluid from below to above the piston but prevents reverse flow. Port 350 communicates with a port 354 within piston rod 206. Port 354 communicates through and into the upper chamber of cylinder 214.

Operation of the proportion pumps is illustrated in FIGS. 4*a* and 4*b*. As is shown in FIG. 4*a*, as the piston 210 moves downwardly in cylinder 214, fluid which is below the piston is forced through port 350 and past check valve 352, through port 354 and into the area above the piston. Because the area above the piston is less than that below the piston, by an amount equal to the volume of piston rod 206, and because inlet check valve 270 is closed under pressure, fluid is forced out of flow line and through check valve 312 to discharge gun 310. Shown in FIG. 4*b*, on the upstroke, valve 352 within piston 210 is closed under pressure and fluid above the piston is discharged under pressure past check valve 312 and into flow line 300 to discharge gun 310. Simultaneously, the chamber below piston 210 is loaded with fluid which is drawn into the cylinder past check valve 270. On the downstroke, this sequence of pumping is repeated with fluid being continuously pumped through lines 300 and 320 to discharge gun 310.

It will be noticed that a different amount of fluid is pumped by proportion pumps on the downstroke than on the upstroke. However, in the present invention, this variation in quantity of fluid is modulated by using an appropriate length of hose between proportion pumps 200 and 202 and the discharge gun 310 and by use of check valves 312 and 322 which prevent return of fluid into the pump cylinders. In one embodiment of the invention, 200 feet or more of hose is used between the proportion pumps and the discharge gun. By using this length of hose, the hose acts as a pressure compensating system and the discharge at the gun 310 is modulated to a uniform pressure.

Moreover, in the present invention, none of the fluid on either the up or down stroke is recirculated through the proportion pump as in prior art devices. Rather, on each stroke, fluid is pumped out of the pumps into the flow lines and back flow into the cylinders is prevented by check valves 312 and 322 mounted at the exhaust ports of pumps 200 and 202. Thus, more efficient pumping is accomplished and uniformity of pressure is achieved by the use of these check valves in conjunction with the hose as a pressure vessel which modulates the pressure to a uniform level at the gun.

When operation of the system is not necessary, such as in between applications of fluid, fluid under pressure is trapped in the hose between check valves 312 and 322 and the discharge gun. By way of switch 356 located on or near the gun (FIG. 1), and connected by lead 358 to junction 290, solenoids 60 and 62 which control valves 32 and 34 and therefore the operation of power cylinder 36, may be actuated to deactivate valves 32 and 34 and thereby vent all pressure within power cylinder 36 to tank. Thus, power cylinder 36 is at rest, without any pressure applied thereto and likewise proportion pumps 200 and 202 are also positioned at rest and without any pressure applied therein. However, as has been mentioned, pressure is maintained in the line between check valves 312 and 322 and gun 310. As a result, the entire system is completely shut down, even though static pressure is still maintained within the line up to gun 310. As a result, no fluid pressure or stress loads are applied to any of the operating pumps or components when the system is not in its pumping mode. Thus, leakage is avoided and wear and fatigue on components is eliminated. This is in distinction to the prior art systems which maintain pressure on the power cylinder as well as on the proportion pumps during the "off" cycle.

When spraying or application is to resume, the operator simply triggers switch 356 which in turn applies the appropriate signal to either solenoid 60 or 62, activates the appropriate valve 32 or 34 to apply pressure on power cylinder 36. Instantaneously, sufficient pressure is applied to provide pumping pressure within proportion pumps 200 and 202 to overcome the pressure at check valves 312 and 322. Thus pumping resumes and the operator can continue the spraying or application process. The operator will know when spraying may resume either by use of gauges applied immediately ahead of check valves 312 and 322 or merely by triggering gun 310 to determine whether a continuous and appropriate pressure is being supplied. It will be appreciated by those skilled in the art that the wait time for such pressurization will be extremely short and thus no delay in use of the pumping system will be experienced.

Therefore, the present invention provides a pumping system which has pumping efficiency not achieved by the prior art systems. Specifically, the power cylinder is operated such that during each power stroke, the back side of the piston is vented to tank through a valve system which has more capacity than is necessary to eliminate any back pressure therein. However, the valving system is capable of then reversing the pump stroke instantaneously while venting the then back side of piston to tank in a way that produces no back pressure thereon. Thus, the power cylinder is extremely efficient and capable of providing large pumping forces with a minimum of horsepower. For example, in one embodiment of the invention, an electric motor of 3 horsepower is used to drive a supply pump which in turn can reciprocate the power system to pump from one through two gallons per minute under 5,000 psi loading.

Further, the proportion pumps are designed such that there is no slippage of the pump through the fluid being pumped as is the case in many prior art systems. Such an arrangement is highly inefficient and is avoided in the present arrangement by permitting the flow of fluid through the piston whereby pumping is achieved on both the up and down stroke. A sufficiently long hose, on the order of 200 feet (60.96 m) or greater in most applications, is used as a means of modulating the pressure rather than using the systems of the prior art which incorporate rapid short strokes and the circulation of fluid from one side of the piston to the opposite side prior to pumping. Further, the present invention provides an arrangement whereby when the spraying or dispensing of the fluid is ceased, the power cylinder may be completely relieved of all pressure by simply venting both sides of the power cylinder to tank. This relieves all of the seals and other components of pressure loads and thereby greatly increases the life of these components. However, simultaneously therewith, pressure is maintained in the line between the proportion pumps and the discharge gun using check valves. The system may be energized immediately and pressure can then be developed in the line instantaneously whenever the spraying or dispensing of the fluid is desired.

Although the illustrations have shown the system as incorporating two proportion pumps for pumping two materials that are then sprayed through one discharge gun, it will be understood that a single fluid may be pumped. Likewise, more than two fluids can be pumped. Where more than a single fluid is pumped, any ratio can be provided by adjusting the design of the proportion pump accordingly. Thus, the present invention is specifically intended to cover uses of the present components and the teachings herein for pumping either a single fluid or multiple fluids as required for particular applications.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the invention.

I claim:

1. A system for pumping one or more fluids comprising:

a drive piston for movement in a drive cylinder;

valve means for controlling the reciprocation of said drive piston by controlling the application of fluid on opposite sides of said piston, said valve means comprising two selectively controllable two-position, three port valves, the three ports being a port to inlet pressure, a port to the drive piston and a port to the non-pressurized tank, said valves being switchable between first and second positions, wherein in the first position, pressurized fluid is communicated above the piston and fluid below the piston is opened to a non-pressurized tank thereby driving said piston in a first direction and wherein in the second position, pressurized fluid is communicated below the piston and fluid above the piston is opened to a non-pressurized tank thereby driving said piston in a second direction;

pump piston means driven by the reciprocating movement of said drive piston for pumping said one or more fluids to a discharge; and switch means for simultaneously switching both said valves to their off position wherein the drive cylinder port is connected to the tank port and wherein in said off position, spring means switches said valves to connect the cylinder port to the tank port.

2. A system of for pumping one or more fluids comprising:

a drive piston for movement in a drive cylinder;

valve means for controlling the reciprocation of said drive piston by controlling the application of fluid on opposite sides of said piston, said valve means comprising two selectively controllable two-position, three port valves, the three ports being a port to inlet pressure, a port to the drive piston and a port to the non-pressurized tank, said valves being switchable between first and second positions, wherein in the first position, pressurized fluid is communicated above the piston and fluid below the piston is opened to a non-pressurized tank thereby driving said piston in a first direction and wherein in the second position, pressurized fluid is communicated below the piston and fluid above the piston is opened to a non-pressurized tank thereby driving said piston in a second direction;

pump piston means driven by the reciprocating movement of said drive piston for pumping said one or more fluids to a discharge; and switch means for simultaneously switching both said valve to their off position wherein the drive cylinder port is connected to the tank port and wherein when said valves are in their closed position, the inlet pressure port is blocked.

3. A system of for pumping one or more fluids comprising:

a drive pump comprising a piston for reciprocation in a cylinder;

one or more fluid pumps, each comprising a piston, attached to a piston rod, for reciprocation in a cylinder;

means for transmitting the reciprocating motion of said drive pump piston to each fluid pump piston thereby reciprocating said piston;

valve means for controlling the flow of pressured fluid above and below said drive pump piston in each case opening one end of the cylinder to a non-pressurized tank when pressure is communicated to the opposite side of the cylinder such that there is no resisitive pressure during any pumping stroke, wherein said drive pump piston valves means comprise two, two-position, three-port valves, the three ports being a port to inlet pressure, a port to the drive piston and a port to the non-pressurized tank;

a discharge in the end of said fluid pump cylinder occupied by the piston rod;

an inlet in said fluid pump cylinder on the side of said piston opposite said discharge;

valve means in said inlet permitting the flow of fluid into said fluid pump cylinder by preventing flow past said valve means out of said fluid pump cylinder;

piston valve means through said piston for permitting flow from the inlet side of the piton to the discharge side but preventing flow from the discharge side to the inlet side;

seal means between the fluid pump piston and fluid pump cylinder to form a fluid seal therebetween, preventing the flow of fluid between said piston and cylinder during any movement of the piston or while the piston is at rest; and switch means for simultaneously switching both said drive pump piston valves to their off position wherein the drive cylinder port is connected to the tank port, wherein in said off position, spring means switches said valves to connect the cylinder port to the tank port.

4. A system of for pumping one or more fluids comprising:

a drive pump comprising a piston for reciprocation in a cylinder;

one or more fluid pumps, each comprising a piston, attached to a piston rod, for reciprocation in a cylinder;

means for transmitting the reciprocating motion of said drive pump piston to each fluid pump piston thereby reciprocating said piston;

valve means for controlling the flow of pressured fluid above and below said drive pump piston in each case opening one end of the cylinder to a non-pressurized tank when pressure is communicated to the opposite side of the cylinder such that there is no resisitive pressure during any pumping stroke, wherein said drive pump piston valves means comprise two, two-position, three-port valves, the three ports being a port to inlet pressure, a port to the drive piston and a port to the non-pressurized tank;

a discharge in the end of said fluid pump cylinder occupied by the piston rod;

an inlet in said fluid pump cylinder on the side of said piston opposite said discharge;

valve means in said inlet permitting the flow of fluid into said fluid pump cylinder by preventing flow past said valve means out of said fluid pump cylinder;

piston valve means through said piston for permitting flow from the inlet side of the piton to the discharge side but preventing flow from the discharge side to the inlet side;

seal means between the fluid pump piston and fluid pump cylinder to form a fluid seal therebetween. preventing the flow of fluid between said piston and cylinder during any movement of the piston or while the piston is at rest;

switch means for simultaneously switching both said drive pump piston valves to their off position wherein the drive cylinder port is connected to the tank port, wherein when said valves are in their closed position, the inlet pressure port is blocked.

5. A system of for pumping one or more fluids comprising:

a drive pump comprising a piston for reciprocation in a cylinder;

one or more fluid pumps, each comprising a piston, attached to a piston rod, for reciprocation in a cylinder to pump fluid to a discharge;

means for transmitting the reciprocating motion of said drive pump piston to each fluid pump piston thereby reciprocating said piston;

valve means for alternately flowing pressurized fluid to opposite sides of said drive pump piston in each case opening one end of the cylinder to a tank when pressure is communicated to the opposite end of the cylinder such that there is no resisitive pressure during any pumping stroke, said opening of the cylinder to tank having a greater fluid flow capacity than the fluid flow capacity to the drive pump piston, wherein said valve means comprise two, two-position, three-port valves, the three ports being a port to inlet pressure, a port to the drive piston and a port to tank; and switch means for simultaneously switching both said valves to their off position wherein the drive cylinder port is connected to the tank port, wherein in said off position, spring means switches said valves to connect the cylinder port to the tank port.

6. A system for pumping one or more fluids comprising:

a drive pump comprising a piston for reciprocation in a cylinder;

one or more fluid pumps, each comprising a piston, attached to a piston rod, for reciprocation in a cylinder to pump fluid to a discharge;

means for transmitting the reciprocating motion of said drive pump piston to each fluid pump piston thereby reciprocating said piston;

valve means for alternately flowing pressurized fluid to opposite sides of said drive pump piston in each case opening one end of the cylinder to a tank when pressure is communicated to the opposite end of the cylinder such that there is no resistive pressure during any pumping stroke; said opening of the cylinder to tank having a greater fluid flow capacity than the fluid flow capacity to the drive pump piston, wherein said valve means comprises two, two-position, three-port valves, the three ports being a port to inlet pressure, a port to the drive piston and a port to tank; and switch means for simultaneously switching both said valves to their off position wherein the drive cylinder port is connected to the tank port, wherein when said valves are in their closed position, the inlet pressure port is blocked.

* * * * *